US008596444B2

(12) United States Patent
Nishida et al.

(10) Patent No.: US 8,596,444 B2
(45) Date of Patent: Dec. 3, 2013

(54) PAPER BILL DEPOSITING/DISPENSING APPARATUS

(75) Inventors: Mitsutaka Nishida, Inagi (JP); Hayato Minamishin, Inagi (JP); Satoshi Hayashi, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 13/465,160

(22) Filed: May 7, 2012

(65) Prior Publication Data

US 2012/0298477 A1 Nov. 29, 2012

(30) Foreign Application Priority Data

May 26, 2011 (JP) ..... 2011-118446

(51) Int. Cl.
*G07F 7/04* (2006.01)

(52) U.S. Cl.
USPC ..... 194/206

(58) Field of Classification Search
USPC ..... 194/206, 342, 343, 350, 351; 209/534; 235/379; 271/1, 3.01, 3.02, 3.12, 3.13
See application file for complete search history.

(56) References Cited

U.S. PATENT DOCUMENTS

| | | | | |
|---|---|---|---|---|
| 4,542,287 | A * | 9/1985 | Watanabe | 235/379 |
| 2008/0156613 | A1* | 7/2008 | Park et al. | 194/206 |

FOREIGN PATENT DOCUMENTS

| | | |
|---|---|---|
| JP | 2000-90325 | 3/2000 |
| JP | 2000-099795 | 4/2000 |
| JP | 2000-187752 | 7/2000 |
| JP | 2010-86293 | 4/2010 |
| KR | 10-0227403 | 11/1999 |
| KR | 10-2010-0032492 | 3/2010 |

OTHER PUBLICATIONS

Korean Office Action issued in corresponding Korean App. No. 10-2012-53252, dated Jul. 22, 2013 (with full translation).
Japanese Office Action issued in corresponding Japanese App. No. 2011-118446, dated Sep. 24, 2013 (with partial translation).

* cited by examiner

*Primary Examiner* — Mark Beauchaine
(74) *Attorney, Agent, or Firm* — Greer, Burns & Crain, Ltd.

(57) ABSTRACT

In a paper bill depositing/dispensing apparatus, when a roof plate and a stage plate move from a depositing/dispensing unit to a temporarily accumulating unit along with a deposited bill, rotations of a pick roller, a separator, a feed roller and a conveyance roller are driven to carry a bill to a conveyance path that connects to a bill storing unit, and a partial paddle wheel stops by orientating its round surface, not provided with paddles, toward a path of the carried bill. When a bill is dispensed, the separator, the feed roller and the conveyance roller rotate in a bill carry-in direction to carry the bill conveyed from the conveyance path in the temporarily accumulating unit, and the partial paddle wheel beats a rear end of the carried bill with paddles to align the rear end of the bill at a bottom position d.

1 Claim, 11 Drawing Sheets

PAPER BILL DEPOSITING/DISPENSING APPARATUS

CROSS REFERENCE TO RELATED APPLICATION

This application is based upon and claims the benefit of priority from prior Japanese Application No. 2011-118446, filed on May 26, 2011, the entire contents of which are incorporated herein by reference.

BACKGROUND OF THE INVENTION

1. Field of the Invention

The present invention relates to a paper bill depositing/dispensing apparatus, and more particularly, to a paper bill depositing/dispensing apparatus that can collectively dispense bills of different sizes by accumulating them as a steady bundle when dispensing the bills with one simple and compact mechanism that can execute a deposit process and a dispensing process in an ATM (Automated Teller Machine) or the like.

2. Description of the Related Art

Conventionally, an apparatus that feeds bills to a conveyance path with a feeding mechanism from a stacker or a cassette for accumulating a predetermined number of bills according to each denomination, accumulates, from the conveyance path, bills in a temporarily accumulating unit of a predetermined size suitable for a bill of a maximum size, and collectively passes the bills to a customer is proposed by Japanese Laid-open Patent Publication No. 2000-99795 as an apparatus for collectively dispensing bills of different sizes, such as Euro bills or the like, as a bundle of the bills according to a face value.

According to Japanese Laid-open Patent Publication No. 2000-99795, bills are fed in order according to each denomination and accumulated in the temporarily accumulating unit when the bills are dispensed as described above. In the temporarily accumulating unit, a paper bill accumulation mechanism composed of a stack roller, a backup roller and a brush roller is arranged.

A rear end of each bill fed by the stack roller and the backup roller into the temporarily accumulating unit is beaten by paddles of the brush roller so that the bill is accumulated without colliding with a succeeding bill.

Additionally, with the technique recited in Japanese Laid-open Patent Publication No. 2000-99795, when bills are deposited, a bundle of the bills that are deposited and stored in the temporarily accumulating unit is separated one by one with a separation mechanism that is arranged at a position away from the paper accumulation mechanism and composed of a feed roller and a gate roller, and fed to a conveyance path that connects to a storing unit with a pinch roller, a feed roller, a driving roller and the like.

Furthermore, for such an apparatus, also a function of automatically removing a bill if a customer accidentally leaves the bill and of shifting to the next transactional state is important. Normally, a bill is automatically fed from the temporarily accumulating unit to the conveyance path and moved from the conveyance path to a left bill storing unit in a similar manner as in the case of depositing a bill.

Incidentally, the temporarily accumulating unit that also serves as an insertion/withdrawal slot recited in Japanese Laid-open Patent Publication No. 2000-99795 is independently provided with a separation mechanism and a conveyance mechanism, which are dedicated to a bill insertion. Accordingly, this technique has a problem that the configuration of the temporarily accumulating unit is extremely complicated and the apparatus is increased in size by the mechanism portion.

Additionally, for example, to store bills of different sizes, such as Euro bills, according to a face value in the temporarily accumulating unit, the bills are normally accumulated in a way such that the rear end of each bill to be accumulated is beaten by paddles of the brush roller as recited in Japanese Laid-open Patent Publication No. 2000-99795.

However, if the paddles of the brush rollers are too short, they cannot sufficiently press a bill. In contrast, if the paddles are too long, a bill having low stiffness can be possibly wound, leading to an occurrence of jamming. Therefore, this technique has an yet-to-be-solved problem of having limitation on a size of an available bill when steadily accumulating bills.

SUMMARY OF THE INVENTION

The present invention overcomes the above described conventional problem, and an object thereof is to provide a paper bill depositing/dispensing apparatus that can collectively dispense bills of different sizes by accumulating them as a steady bundle when dispensing the bills with one simple and compact mechanism that can execute a deposit process and a dispensing process.

To overcome the above described problem, a paper bill depositing/dispensing apparatus according to the present invention includes: a depositing/dispensing unit that functions as a paper bill temporarily storing part used when a customer inserts a bill in an insertion/withdrawal slot at the time of depositing the bill by the customer and a customer takes a bill out of the insertion/withdrawal slot at the time of dispensing the bill to the customer; a temporarily accumulating unit for feeding the inserted bill from the depositing/dispensing unit to a conveyance path when the bill is deposited, and for moving a withdrawn bill fed from the conveyance path to the depositing/dispensing unit when the bill is dispensed; paper bill accumulating means movable along a moving path between the depositing/dispensing unit and the temporarily accumulating unit; a pick roller provided in the temporarily accumulating unit; a feed roller, a separator, a conveyance roller and a partial paddle wheel, which are arranged between the temporarily accumulating unit and the conveyance path; and an alignment lever arranged in the temporarily accumulating unit. The paper bill accumulating means forms an inserted bill accepting part or a withdrawn bill dispensing part below the insertion/withdrawal slot when moving to the depositing/dispensing unit, or forms an inserted bill feeding part or a withdrawn bill temporarily accumulating part when moving to the temporarily accumulating unit. When the paper bill accumulating means forms the inserted bill feeding part, the pick roller feeds each topmost bill in a direction of the feed roller by making pressure contact with a bundle of bills stored in the inserted bill feeding part, the feed roller carries the fed bill to the conveyance path along with the conveyance roller, and the partial paddle wheel stops by orientating its round surface, not provided with paddles, toward a path of the carried bill. When the paper bill accumulating means forms the withdrawn bill temporarily accumulating part, the conveyance roller carries the bill conveyed from the conveyance path to the withdrawn bill temporarily accumulating part along with the feed roller and the separator, the alignment lever regulates a front end of the bill so that a rear end of the bill carried in the withdrawn bill temporarily accumulating part is positioned at a bottom of the withdrawn bill temporarily accumulating part, and the partial paddle wheel prevents the succeedingly carried bill from colliding with a precedingly carried bill by rotating to beat the rear end of the bill carried in the withdrawn bill temporarily accumulating part with paddles.

The paper bill accumulating means is configured by including a roof plate that is erected nearly vertically to the moving path and arranged on the side of the temporarily accumulating unit, and a stage plate that is erected nearly vertically to the moving path and arranged on the side of the depositing/dispensing unit.

Additionally, the alignment lever uses, as a retracted position, a position corresponding to a position of a front end of a bill of a maximum size carried in the withdrawn bill temporarily accumulating part, and regulates a front end of a bill of a predetermined size or smaller by descending from the retracted position if the bill carried in the withdrawn bill temporarily accumulating part is the bill of the predetermined size or smaller.

As described above, the present invention can provide a paper bill depositing/dispensing apparatus that can collectively dispense bills of different sizes by accumulating them as a steady bundle when dispensing the bills with one simple and compact mechanism that can execute a deposit process and a dispensing process.

DESCRIPTION OF THE PREFERRED EMBODIMENTS

An embodiment according to the present invention is described below with reference to the drawings.

An Embodiment

Figure 1:
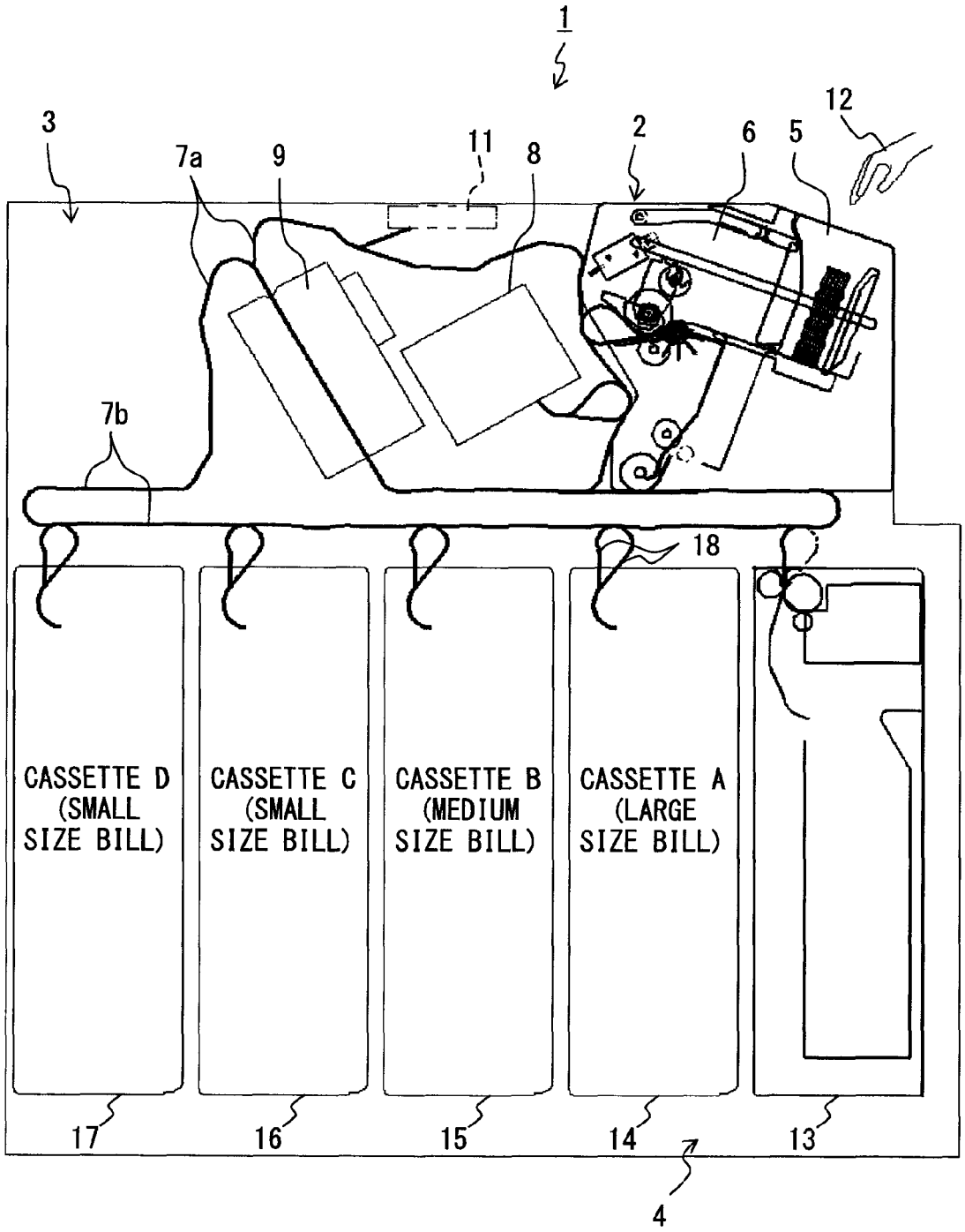
FIG. 1 is a cross-sectional view schematically illustrating a configuration of an ATM (Automated Teller Machine: hereinafter referred to also as a main body apparatus) including a paper bill depositing/dispensing apparatus according to an embodiment of the present invention.

FIG. 1 is a cross-sectional view schematically illustrating a configuration of an ATM (Automated Teller Machine) (hereinafter referred to also as a main body apparatus) including a paper bill depositing/dispensing apparatus according to a first embodiment. The ATM 1 illustrated in this figure includes a bill depositing/dispensing apparatus 2, a conveying unit 3 and a storing unit 4.

The paper bill depositing/dispensing apparatus 2 has an input operation panel unit, which is not illustrated because of the cross-section in FIG. 1, on an upper surface formed by being slightly tilted on a front side (right side of FIG. 1) of the apparatus, a depositing/dispensing unit 5 having a shutter in a top opening portion, and a temporarily accumulating unit 6 for temporarily storing accumulated bills.

In the conveying unit 3, conveyance paths 7 (7*a*, 7*b*) are arranged by being vertically and horizontally extended. The conveyance paths 7 are represented only with black thick lines. However, the conveyance paths 7 are actually configured with many rollers, many belts bridged over the rollers, and switching gates arranged at respective branch points of the conveyance paths.

To the upper conveyance path 7*a* of the main body apparatus 1, a pool unit 8, an identifying unit 9, a dummy bill holding unit 11 and the like are linked. The pool unit 8 temporarily stores a bill that a customer 12 has deposited into the depositing/dispensing unit 5 and is fed to the side of the main body apparatus from the temporarily accumulating unit 6.

If the number of bills counted while being fed matches the number of bills or that indicated by a face value, which the customer 12 has input via the input operation panel unit, bills temporarily stored in the pool unit 8 are fed from the bottom of the pool unit 8 one by one, and conveyed to the identifying unit 9.

The identifying unit 9 determines, for example, whether a bill that passes through inside is either real or counterfeit, whether or not a bill is smudged, or whether or not a corner of a bill is folded. Results of the determination made by the identifying unit 9 are notified to a central processing unit not illustrated.

The central processing unit executes various types of processes based on the above notification while the bill that has passed through the identifying unit 9 is being conveyed on the conveyance path 7*a*.

For example, if the bill is an unacceptable one such as a counterfeit bill or the like, the central processing unit inversely conveys the bill on the conveyance path 7*a* to return to the temporarily accumulating unit 6.

Alternatively, if the bill is not counterfeit but heavily smudged and is expected to be unsuitable for future use, or if the bill needs to be replaced with another one, the central processing unit stores the bill in a reject box 13 in a lower portion or returns it to the temporarily accumulating unit 6.

Alternatively, if the bill is real and not smudged, the central processing unit stores it in the storing unit 4.

In the storing unit 4 positioned below the lower conveyance path 7*b* in the main body apparatus 1, a cassette A14 for storing a bill of a large size, a cassette B15 for storing a bill of a medium size, and cassettes C16 and D17 for respectively storing a bill of a small size are provided to be attachable/detachable in addition to the above reject box 13.

At the top of each of the reject box and the cassettes, a carry-in/carry-out path 18 is provided. To the carry-in/carry-out paths 18, the conveyance path 7*b* is connected via a switching gate not illustrated.

When bills are dispensed to the customer 12, bills of the number and a face value of which correspond to the amount of money that the customer 12 has input on the input operation panel unit are fed to the conveyance path 7*b* from the cassette A14, B15, C16 or D17 corresponding to the bills, and fed into the temporarily accumulating unit 6 from the conveyance path 7*a*.

In the temporarily accumulating unit 6, a bill of a small-size, a bill of a medium size and a bill of a large size are sequentially accumulated in this order. When a total amount of accumulated bills matches the number of bills or the number of bills indicated by a face value, which the customer 12 has input on the input operation panel unit, the accumulated bills are collectively dispensed to the depositing/dispensing unit 5.

Figure 2:
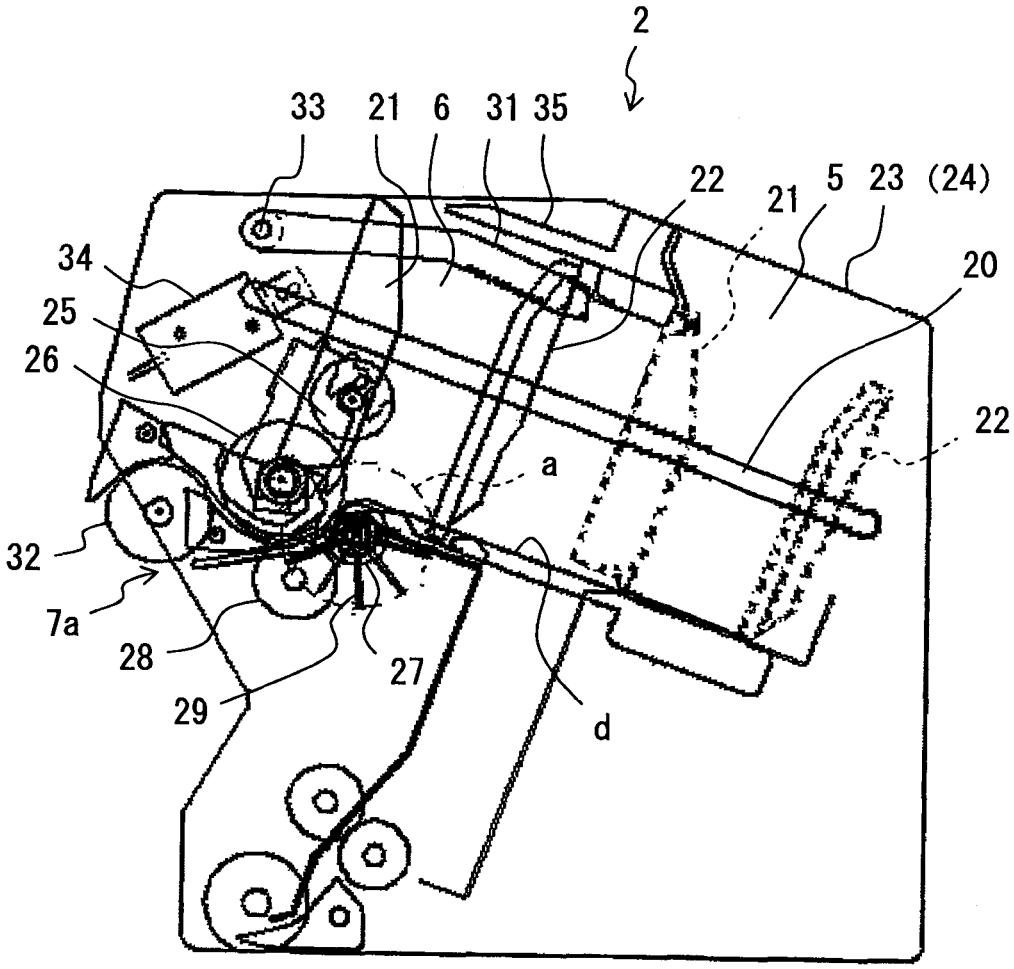
FIG. 2 is an enlarged view of the paper bill depositing/dispensing apparatus according to the embodiment.

FIG. 2 is an enlarged view of the paper bill depositing/dispensing apparatus 2. As illustrated in this figure, the paper bill depositing/dispensing apparatus 2 is provided with a roof plate 21 and a stage plate 22, which are driven to move forward or backward in a longitudinal direction of a long groove hole 20 from a driving axis not illustrated via the long groove hole 20 and can move to the depositing/dispensing unit 5 and the temporarily accumulating unit 6.

In FIG. 2, the roof plate 21 and the stage plate 22 when they move to the temporarily accumulating unit 6 are represented with solid lines, whereas the roof plate 21 and the stage plate 22 when they move to the depositing/dispensing unit 5 are represented with broken lines.

The roof plate 21 and the stage plate 22 form an inserted bill accepting part (when a bill is deposited) or a withdrawn bill dispensing part (when a bill is dispensed) below an insertion/withdrawal slot 23 when they move to the depositing/dispensing unit 5 (broken-line positions). A top portion of the depositing/dispensing unit 5 is open to form the insertion/withdrawal slot 23, and the opening portion is provided with a shutter 24.

Additionally, the roof plate 21 and the stage plate 22 form an inserted bill feeding part (when a bill is deposited) and a withdrawn bill temporarily accumulating part (when a bill is dispensed) when they move to the temporarily accumulating unit 6 (solid-line positions).

In the temporarily accumulating unit 6, a pick roller 25 is provided on the left of a central portion, and a feed roller 26, a separator 27, a conveyance roller 28, a partial paddle wheel 29 and the like are provided in a lower portion. Moreover, an alignment lever 31 is arranged in an upper portion of the temporarily accumulating unit 6.

The above described feed roller 26, separator 27, conveyance roller 28 and partial paddle wheel 29 form a carry-out slot for carrying an accumulated bill that has moved to the temporarily accumulating unit 6 to the conveyance path 7*a* that connects to the bill storing unit such as the pool unit 8, the cassette A and the like when the bill is deposited, or forms a carry-in slot for carrying a bill conveyed from the conveyance path 7*a* that connects to the bill storing unit when the bill is dispensed.

The conveyance path 7*a* that directly connects to the above described carry-out slot (or the carry-in slot. The same applies hereinafter), a conveyance roller 32 of the conveyance path 7*a* is provided immediately after the carry-out slot. The conveyance roller 32 conveys a bill carried from the temporarily accumulating unit 6 to the conveyance path 7*a* in a bill storage direction when the bill is deposited, or feeds a bill that is taken out of the bill storing unit and conveyed by the conveyance path 7*a* into the temporarily accumulating unit 6 when the bill is dispensed.

A left end of the alignment lever 31 is supported by a rotational axis 33, whereas its right end side is driven by a solenoid 34 to turn upward and downward via the rotational axis 33.

A position where an upper surface of the right end side of the alignment lever 31 touches a stopper 35 is a retracted position (or a standby position). The alignment lever 31 illustrated in FIG. 2 is in a state of descending from the retracted position and being located at a descent position.

The partial paddle wheel 29 stops by orientating its round surface, not provided with paddles, toward the feed roller 26 when a bill is deposited. When a bill is dispensed, the partial paddle wheel 29 starts to rotate, and tips of the paddles rotate in a range indicated with a broken-line circle a.

Figure 3A:
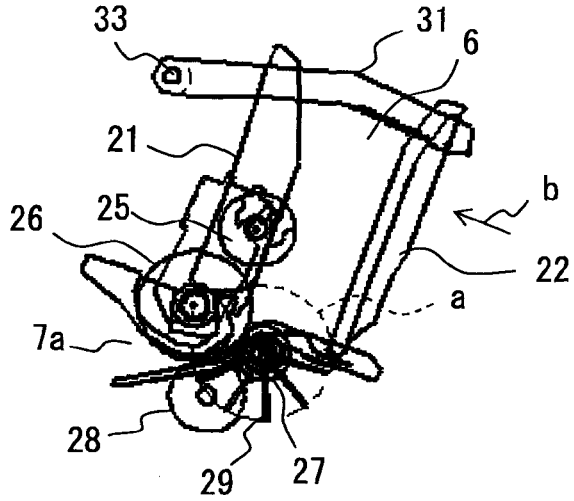
FIG. 3A illustrates a relationship between an alignment lever and a stage plate in a configuration of a main portion of the paper bill depositing/dispensing apparatus according to the embodiment, and also illustrates a state where a roof plate and the stage plate move to a temporarily accumulating unit.

FIG. 3A illustrates a relationship between the alignment lever 31 and the stage plate 22, and also a state where the roof plate 21 and the stage plate 22 move to the temporarily accumulating unit 6.

Figure 3B:
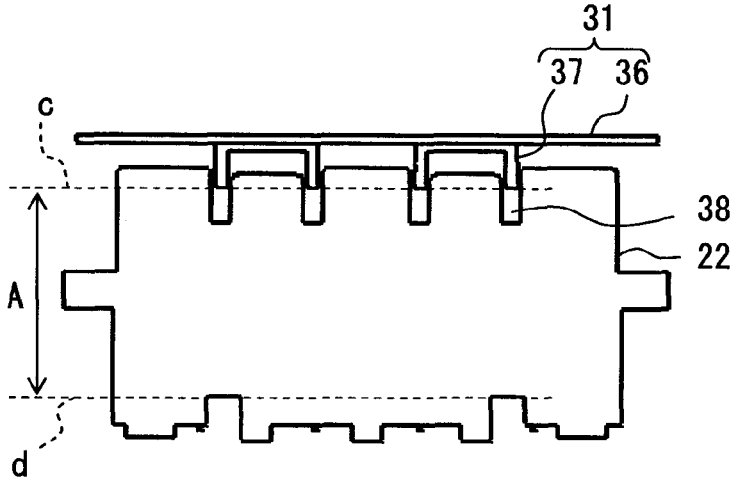
FIG. 3B illustrates a positional relationship between comb teeth and cutout grooves when the alignment lever is located at a retracted position in the case of viewing FIG. 3A in a direction of an arrow b.

FIG. 3B illustrates a positional relationship between comb teeth 37 and cutout grooves 38 when the alignment lever 31 is located at the retracted position in FIG. 3A in the case of viewing FIG. 3A in a direction of an arrow b.

Figure 3C:
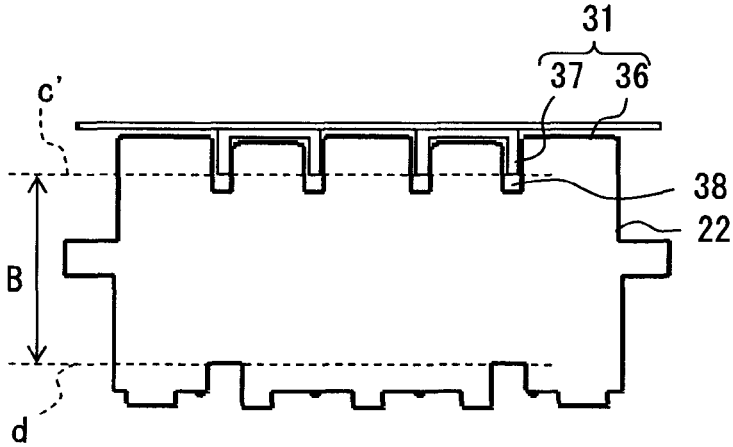
FIG. 3C illustrates a positional relationship between the comb teeth and the cutout grooves when the alignment lever is located at a descent position in the case of viewing FIG. 3A in the direction of the arrow b.

FIG. 3C illustrates a positional relationship between the comb teeth 37 and the cutout grooves 38 when the alignment lever 31 is located at the descent position in the case of viewing FIG. 3A in the direction of the arrow b.

Note that FIG. 3A illustrates only the configuration of the main portion of the paper bill depositing/dispensing apparatus 2 illustrated in FIG. 1 or 2, and omits the other portions. Moreover, in FIGS. 3A and 3C, the same components as those in the configuration in FIG. 1 or 2 are denoted with the same reference numerals as those of FIG. 1 or 2.

As illustrated in FIGS. 3B and 3C, the alignment lever 31 is composed of a holding part lever 36, and the plurality of comb teeth 37 held by the holding part lever 36. An innermost end of the holding part lever 36 in a depth direction of the figures is supported by the rotational axis 33 illustrated in FIG. 3A.

On the stage plate 22, the cutout grooves 38 into which the comb teeth 37 protrude are formed. FIG. 3B illustrates a positional relationship between the comb teeth 37 and the cutout grooves 38 when the alignment lever 31 is located at the retracted position. At this time, the tips of the comb teeth 37 are set to be located at the retracted position c.

FIG. 3C illustrates a positional relationship between the comb teeth 37 and the cutout grooves 38 when the alignment lever 31 is located at the decent position. At this time, the tips of the comb teeth 37 are set to be located at the descent position c'.

A distance A between a bottom position d of the temporarily accumulating unit 6 and the retracted position c of the comb teeth 37 corresponds to a size of a large bill, whereas a distance B between the bottom position d of the temporarily accumulating unit 6 and the descent position c' of the comb teeth 37 corresponds to a bill of a predetermined size or smaller.

Figure 4A:
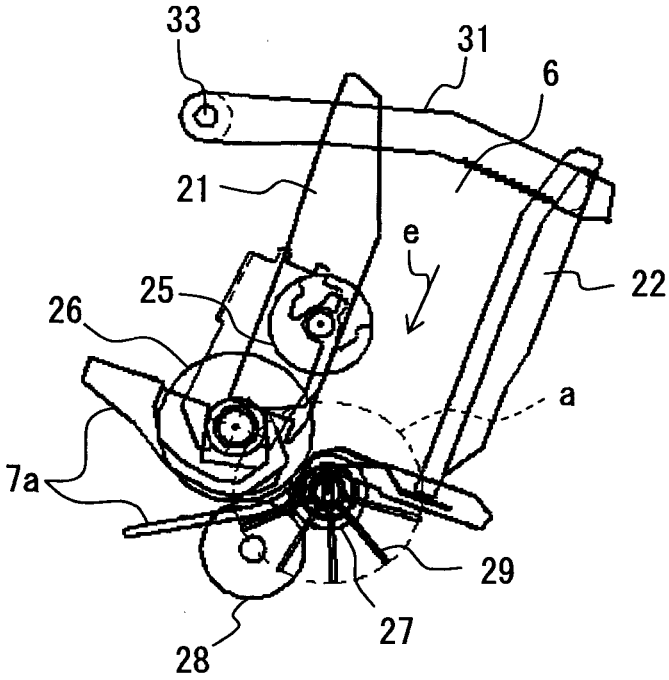
FIG. 4A is a side view illustrating a positional relationship among a feed roller, a separator, a conveyance roller and a partial paddle wheel of the paper bill depositing/dispensing apparatus according to the embodiment.

FIG. 4A is a side view illustrating a positional relationship among the feed roller 26, the separator 27, the conveyance roller 28 and the partial paddle wheel 29. FIG. 4A illustrates only the configuration of the main portion of the paper bill depositing/dispensing apparatus 2 illustrated in FIG. 1 to FIG. 2, and omits the other portions.

Figure 4B:
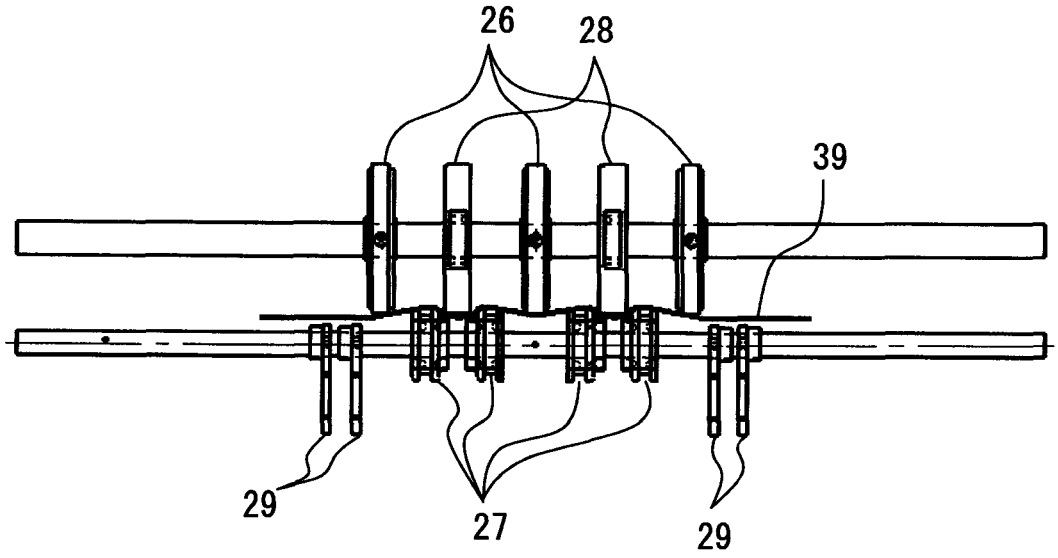
FIG. 4B illustrates the configuration of FIG. 4A, which is viewed in a direction of an arrow e and in which a bill is additionally illustrated.

FIG. 4B illustrates the configuration of FIG. 4A, in which a bill is additionally illustrated, when viewed in a direction of an arrow e. In FIGS. 4A and 4B, the same components as those in FIG. 1 to FIG. 3 are denoted with the same reference numerals as those of FIG. 1 to FIG. 3.

Figure 5:
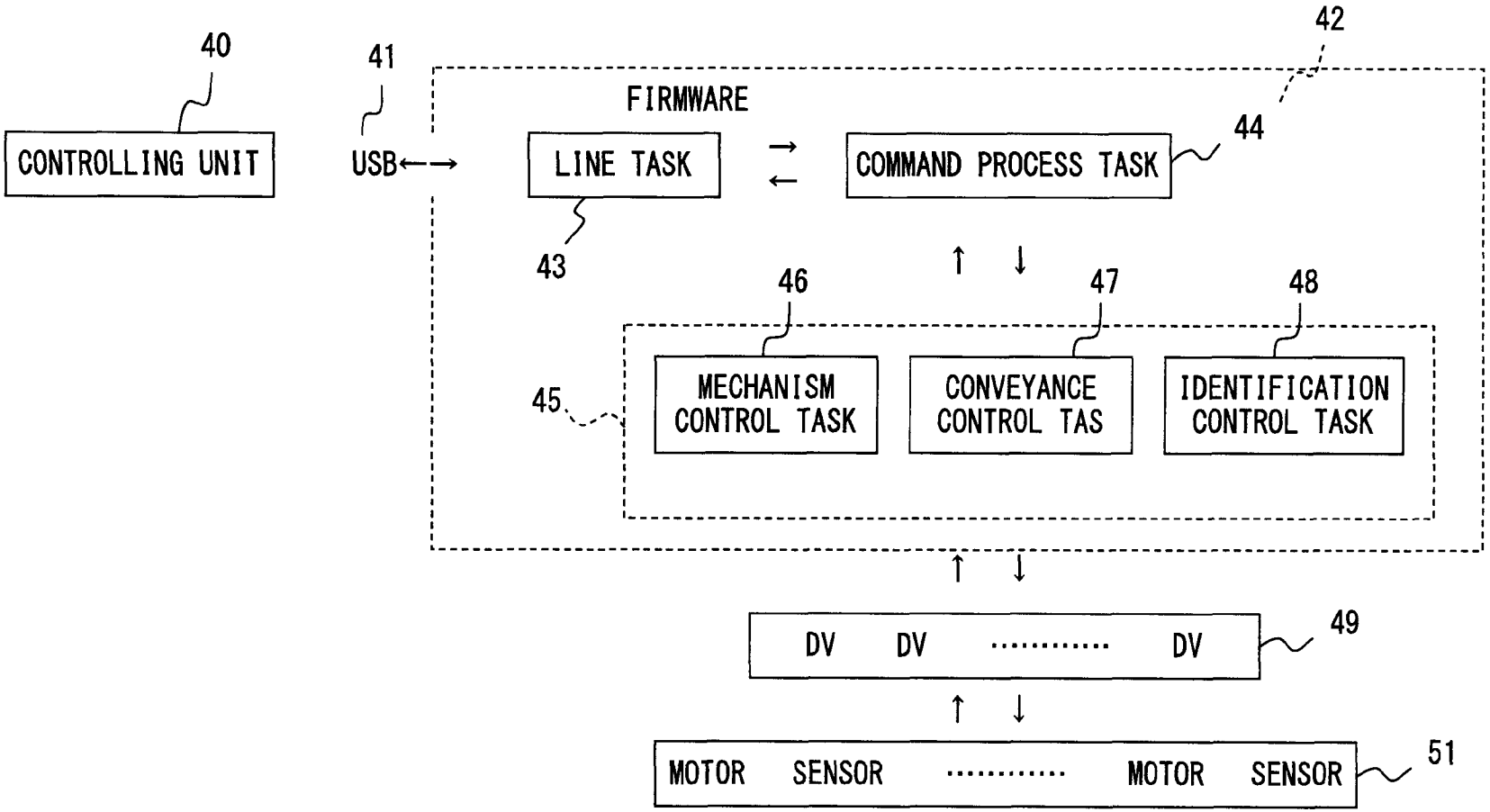
FIG. 5 is a block diagram illustrating a controlling unit for controlling operations of components of the paper bill depositing/dispensing apparatus according to the embodiment, and a process task controlled by the controlling unit.

FIG. 5 is a block diagram illustrating a controlling unit for controlling operations of the components configured as described above, and also a process task controlled by the controlling unit. As illustrated in FIG. 5, the controlling unit 40 transmits a command of each task type to a processing unit 42 of the paper bill depositing/dispensing apparatus 2 via a USB (Universal Serial Bus) 41.

Firmware of the processing unit 42 is composed of a line task 43, a command processing task 44 and a control task unit 45. The control task unit 45 is composed of a mechanism control task 46, a conveyance control task 47, an identification control task 38 and the like.

The line task 43 receives a command transmitted from the controlling unit 40 via the USB 41, and passes the received command to the command process task 44. The command process task 44 generates a control task according to the received command, and passes the generated control task to the control task unit 45.

The control task unit 45 controls driving of each driver (DV) of a driver unit 49 according to the received control task, namely, the mechanism control task 46, the conveyance control task 47 or the identification control task 48.

Each driver (DV) of the driver unit 49 controls driving of a corresponding motor, sensor or the like of a unit to be driven 51 according to the above driving control.

Figure 6A:
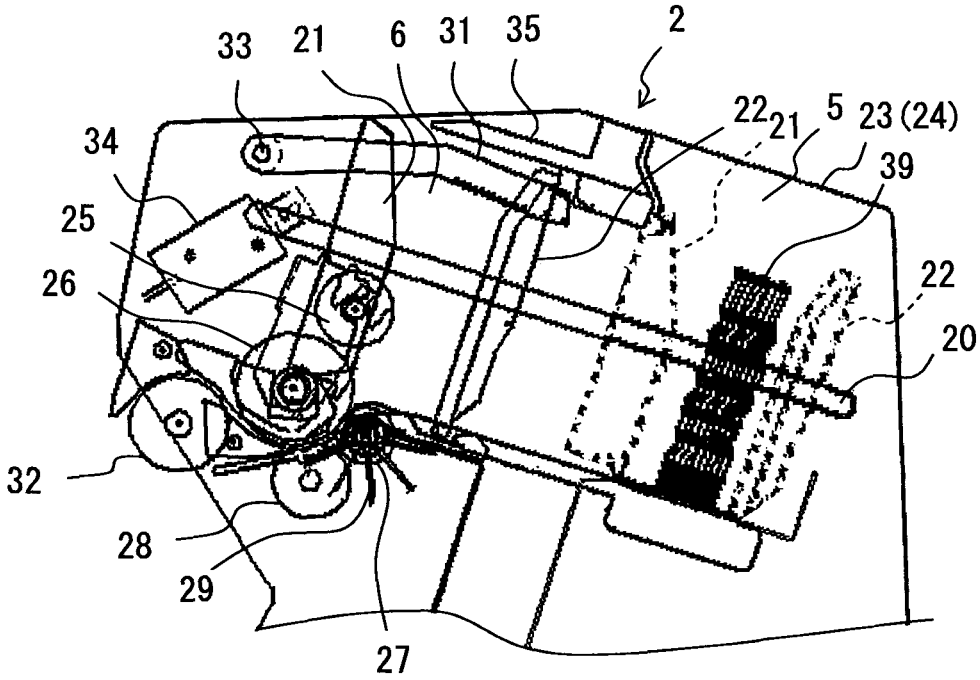
FIG. 6A illustrates an initial state of operations of the components at the time of a deposit process of the paper bill depositing/dispensing apparatus according to the embodiment.
Figure 6B:
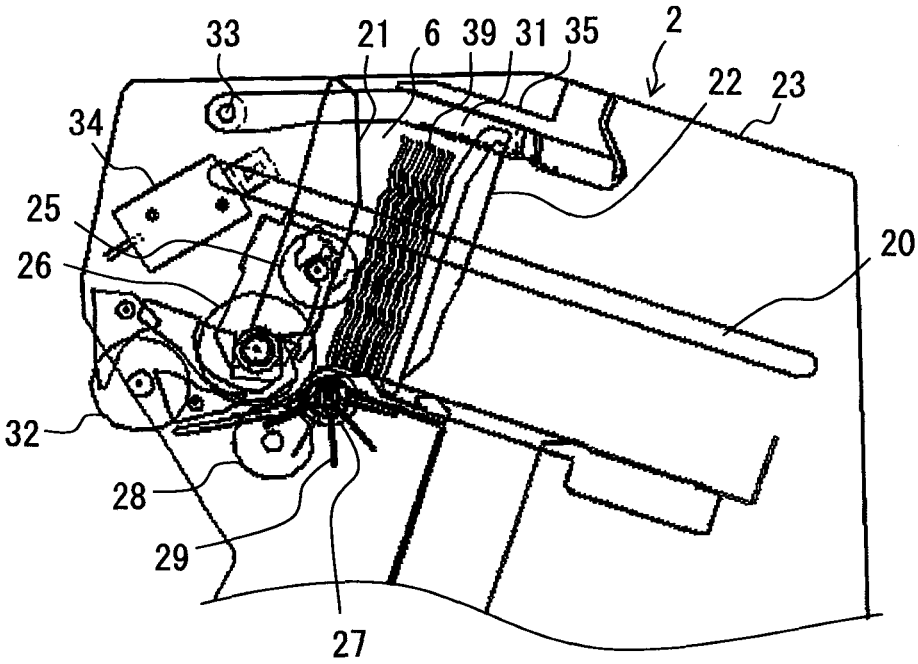
FIG. 6B illustrates a state of operations of the components succeeding FIG. 6A.
Figure 7:
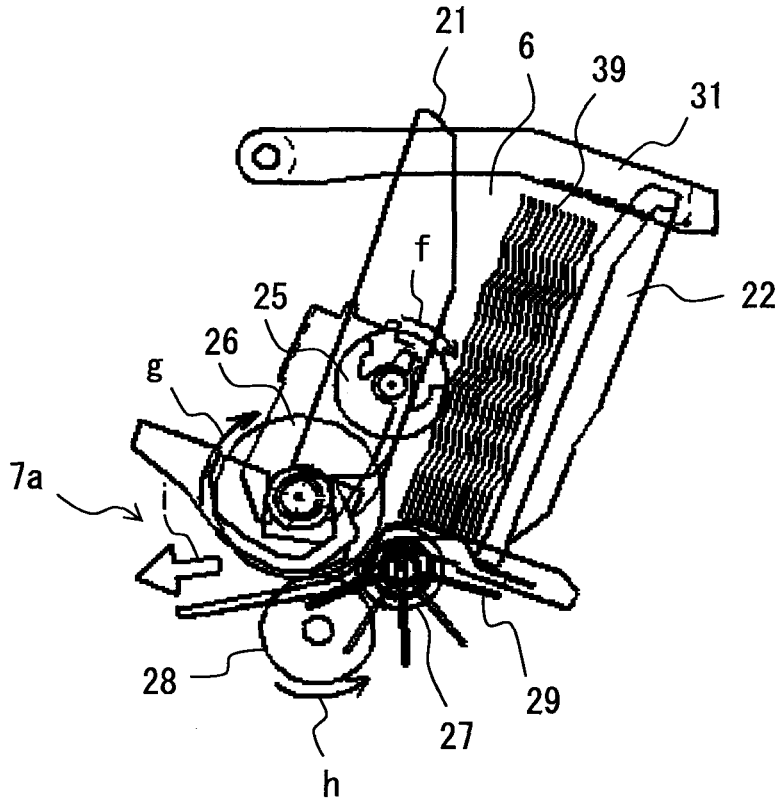
FIG. 7 illustrates a state of operations of the components succeeding FIG. 6B.

FIGS. 6A, 6B and 7 illustrate operation states of the components of the paper bill depositing/dispensing apparatus 2 at the time of the deposit process. In FIGS. 6A and 6B, the same components as those of the configuration illustrated in FIG. 1 to FIG. 4 are denoted with the same reference numerals as those in FIG. 1 to FIG. 4.

FIG. 7 illustrates only the configuration of the main portion of the paper bill depositing/dispensing apparatus 2 illustrated in FIGS. 6A and 6B, and omits the other portions.

FIG. 6A illustrates a state where the roof plate 21 and the stage plate 22 move to the depositing/dispensing unit 5 (broken-line positions), form an inserted bill accepting part in the depositing/dispensing unit 5 below the insertion/withdrawal slot 23, and the shutter 24 is opened to make the customer 12 (see FIG. 1) insert a bundle of bills 39 in the inserted bill accepting part (see FIG. 1).

FIG. 6B illustrates a state where the roof plate 21 and the stage plate 22 are moved by the driving axis, not illustrated, to the temporarily accumulating unit 6 via the long groove hole 20 while sandwiching the bundle of bills 39. Here, the alignment lever 31 is retracted to the retracted position, and the pick roller 25 makes pressure contact with a surface of the bundle of bills 39 on the side of the roof plate 21.

As illustrated in FIG. 7, the pick roller 25 rotates in a clockwise direction indicated with an arrow f, and sequentially feeds each topmost bill 39 of the bundle of bills 39 stored in the inserted bill feeding part in a direction of the feed roller 26.

The feed roller 26 sandwiches the fed bill 39 along with the conveyance roller 28. The feed roller 26 rotates in the clockwise direction indicated with an arrow g, whereas the conveyance roller 28 rotates in a counterclockwise direction indicated with an arrow h, so that the sandwiched bill 39 is conveyed to the conveyance path 7*a* that connects to the bill storing unit.

At this time, the separator 27 rotates in the clockwise direction of this figure, and prevents a bill immediately below the bill fed by the pick roller 25 from being picked and fed together. The partial paddle wheel 29 stops by orientating its round surface, not provided with paddles, toward a path of the conveyed bill. As a result, the bundle of deposited bills 39 is sequentially carried from the temporarily accumulating unit 6 to the conveyance path 7*a* one by one as indicated with an arrow i.

Figure 8A:
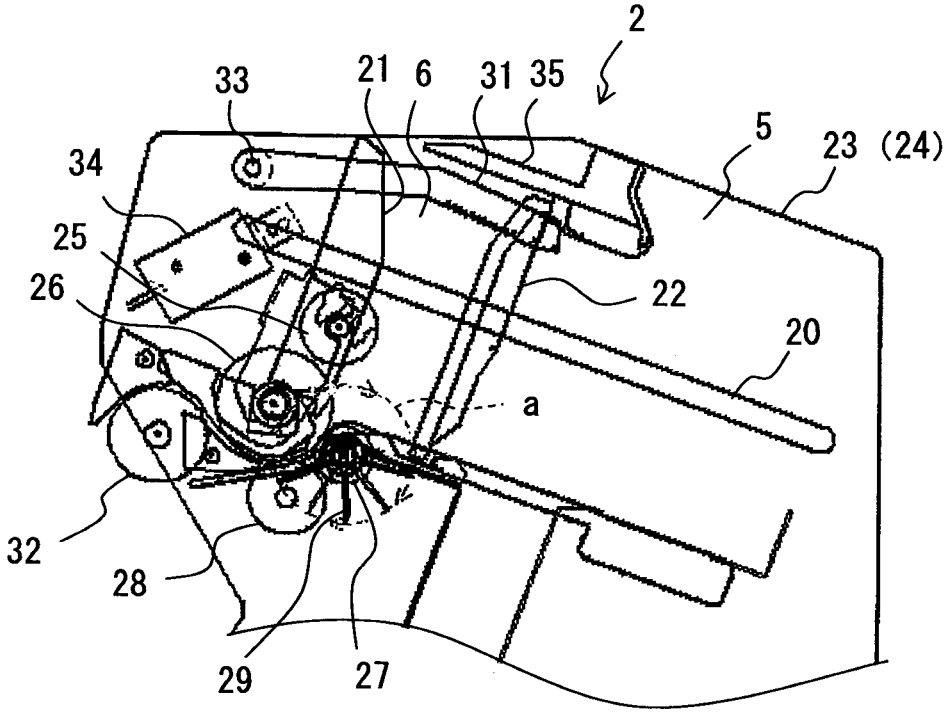
FIG. 8A illustrates a state of basic operations of the components at the time of a dispensing process of the paper bill depositing/dispensing apparatus according to the embodiment.

FIG. 8A illustrates a basic operation state of the components at the time of the dispensing process of the paper bill depositing/dispensing apparatus 2.

Figure 8B:
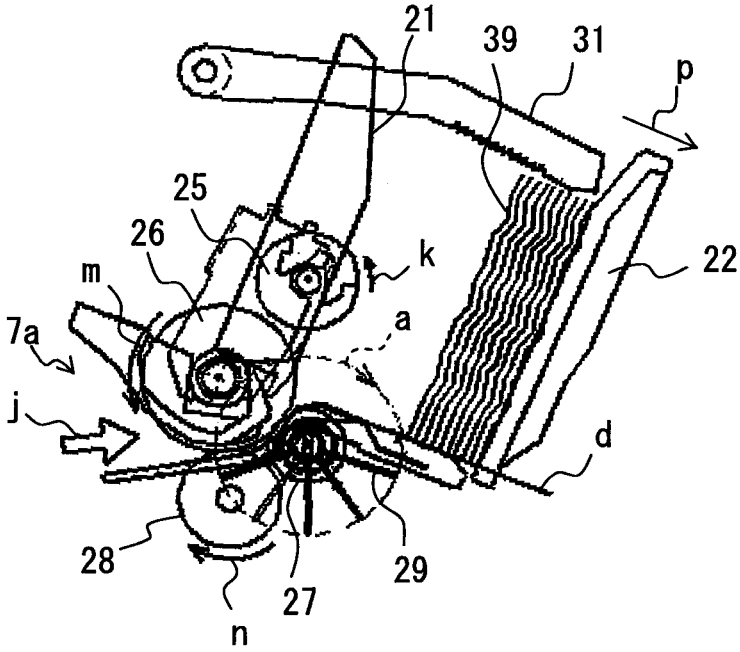
FIG. 8B slightly expands and illustrates only a configuration of a main portion of FIG. 8A, and omits other portions.

FIG. 8B slightly enlarges and illustrates the configuration of the main portion of FIG. 8A, and omits the other portions. In FIG. 8A, the same components as those in FIG. 1 to FIG. 4 are denoted with the same reference numerals as those in FIG. 1 to FIG. 4.

As illustrated in FIG. 8A, the roof plate 21 and the stage plate 22 move to the temporarily accumulating unit 6 along the long groove hole 20, and form the withdrawn bill temporarily accumulating part at the time of the dispensing process. The partial paddle wheel 29 starts to rotate, and tips of the paddles of the partial paddle wheel 29 rotate in a range indicated as a broken-line circle a.

Then, as illustrated in FIG. 8B, the feed roller 26 sandwiches the bill conveyed from the conveyance path 7*a* that connects to the bill storing unit as indicated with an arrow j along with the conveyance roller 28 and the separator 27. Note that the separator 27 functions as a carry-in roller along with the feed roller 26 and the conveyance roller 28 at the time of the dispensing process.

The feed roller 26 rotates in the counterclockwise direction as indicated with an arrow m, the conveyance roller 28 rotates in the clockwise direction as indicated with an arrow n, and also the separator 27 rotates in the clockwise direction of FIG. 8B, so that the bill conveyed from the conveyance path 7*a* as indicated with an arrow j is carried in the withdrawn bill temporarily accumulating part formed in the temporarily accumulating unit 6.

At this time, the alignment lever 31 regulates front ends of the bills 39 as illustrated in FIG. 8B so that rear ends of the bills 39 carried in the withdrawn bill temporarily accumulating part are positioned at the bottom d of the withdrawn bill temporarily accumulating part.

The partial paddle wheel 29 prevents a succeedingly carried bill from colliding with a precedingly carried bill by rotating to beat the rear ends of the bills 39 carried in the withdrawn bill temporarily accumulating part. Moreover, the stage plate 22 gradually moves toward the depositing/dispensing unit 5 as indicated with an arrow p as the bills 29 are accumulated, so that the tips of the paddles of the partial paddle wheel 29 properly beat the read end of a carried bill without fail.

As a result, the bills carried in the withdrawn bill temporarily accumulating part are always set at a neighboring position where the rear ends of the carried bills nearly touch the range a where the tips of the paddles of the partial paddle wheel 29 rotate. Therefore, the pick roller 25 that always rotates in synchronization with rotations of the feed roller 26, the conveyance roller 28 and the like makes idle rotations at a position that does not touch the carried bills 39, and does not impede the bill carry-in process.

Figure 9A:
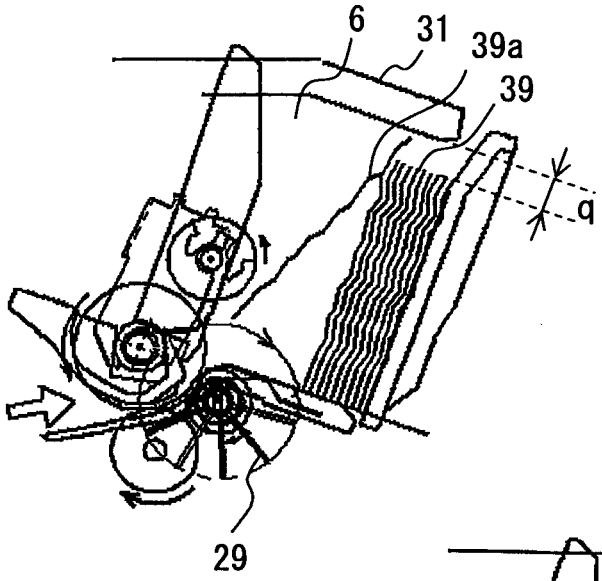
FIGS. 9A, 9B and 9C are explanatory views of a function of an alignment lever at the time of the dispensing process of the paper bill depositing/dispensing apparatus according to the embodiment.
Figure 9B:
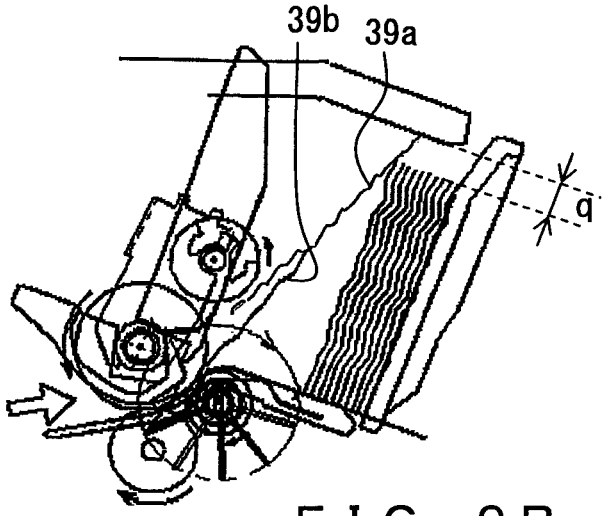
Figure 9C:
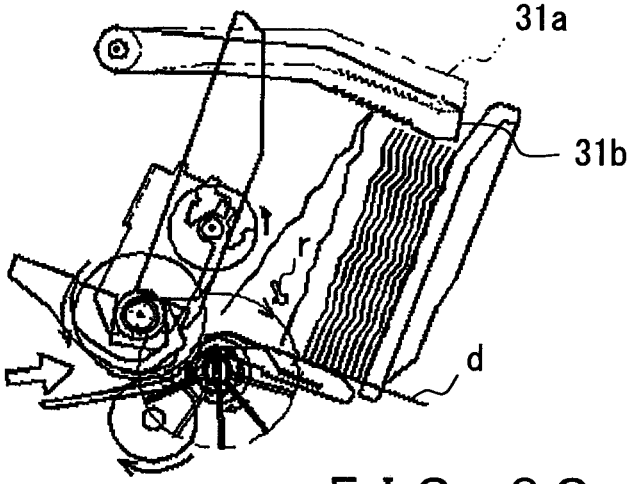

FIGS. 9A, 9B and 9C are explanatory views of the function of the alignment lever 31 when a bill is dispensed. FIGS. 9A, 9B and 9C illustrate only the configuration of the main portion of the paper bill depositing/dispensing apparatus 2 illustrated in FIG. 8A, and omits the other portions.

Assume that the alignment lever 31 illustrated in FIG. 9A is not a turning member illustrated in FIGS. 8A and 8B but a member fixed to a position of a frame of the paper bill depositing/dispensing apparatus 2. If the bundle of carried bills 39 is of a small size when the alignment lever 31 is the fixed member, a gap q occurs between the tips of the bundle of carried bills 39 and the alignment lever 31 as illustrated in FIG. 8A.

Accordingly, the bill 39*a* carried in the withdrawn bill temporarily accumulating part (temporarily accumulating unit 6) at high speed is protruded by inertia by the gap q. Therefore, the rear end of the bill 39*a* goes out of the rotation range a of the tips of the paddles of the partial paddle wheel 29, so that the paddles of the partial paddle wheel 29 cannot beat the rear end of the 39*a* in some cases. As a result, the 39*a* floats within the temporarily accumulating unit 6.

Therefore, as illustrated in FIG. 9B, the succeeding bill 39*b* collides with the floating preceding bill 39*a* when the succeeding bill 39*b* is carried, leading to an occurrence of jamming. However, if the alignment lever 31 is the turning member, it turns from the retracted position 31 to the descent position 31*b* as illustrated in FIG. 9C, so that the gap q illustrated in FIGS. 9A and 9B can be removed.

As a result, the front end of the carried bill is regulated, and its rear end always falls within the rotation range a of the tips of the paddles of the partial paddle wheel 29 as indicated with an arrow r. Therefore, the rear end is beaten by the paddles, and the bill is accumulated by being aligned in close contact with the bundle of earlier carried bills 39. Accordingly, the succeeding bill 39*b* does not collide with the preceding bill 39*a*.

Figure 10:
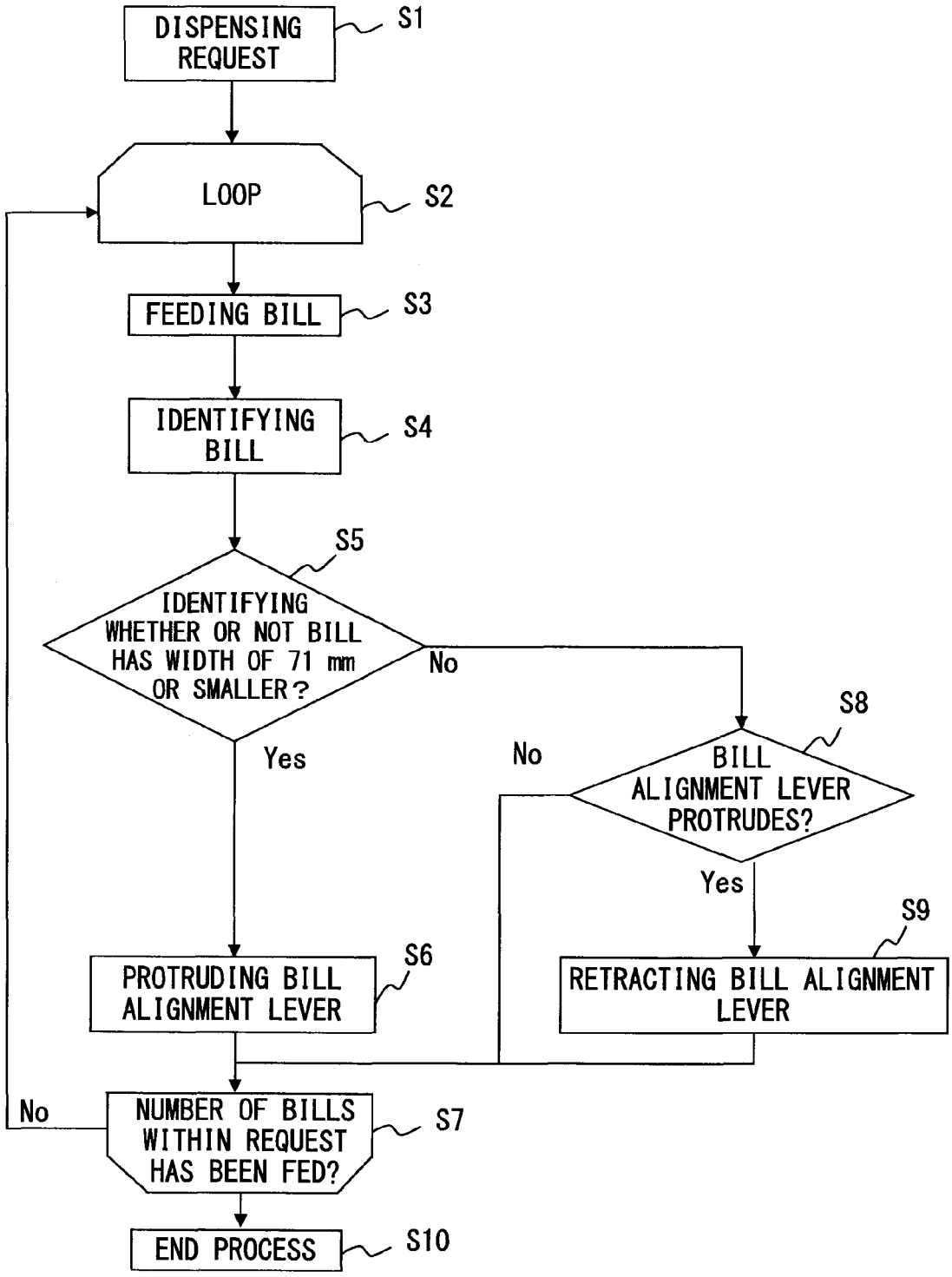
FIG. 10 is a flowchart illustrating a process for controlling turning of the alignment lever when bills having different widths, such as a Euro bills, are accumulated in the temporarily accumulating unit according to a face value at the time of the dispensing process of the paper bill depositing/dispensing apparatus according to the embodiment.

FIG. 10 is a flowchart illustrating a process for controlling the turning of the alignment lever 31 if bills of different widths, such as Euro bills, are accumulated in the temporarily accumulating unit 6 according to a face value when the bills are dispensed.

Figure 11A:
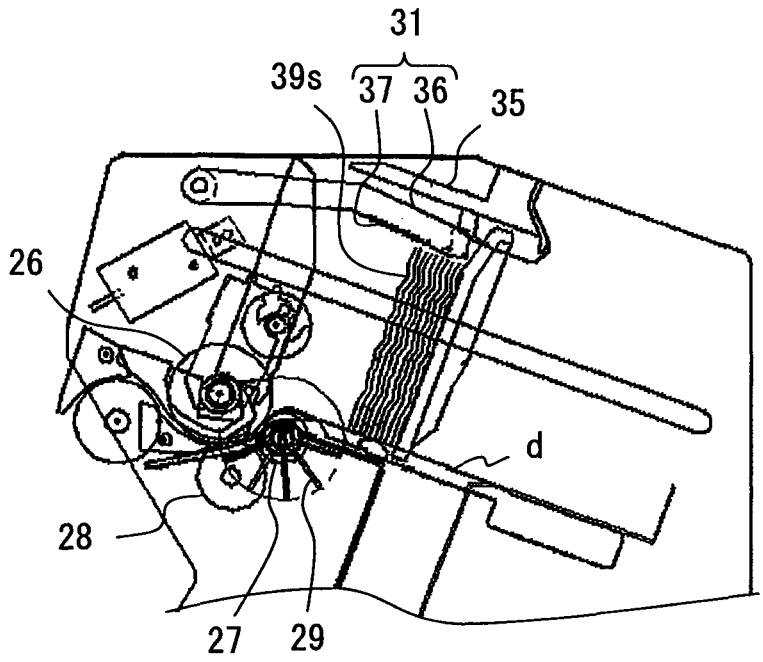
FIGS. 11A and 11B illustrate the turning operations of the alignment lever in the process of FIG. 10.
Figure 11B:
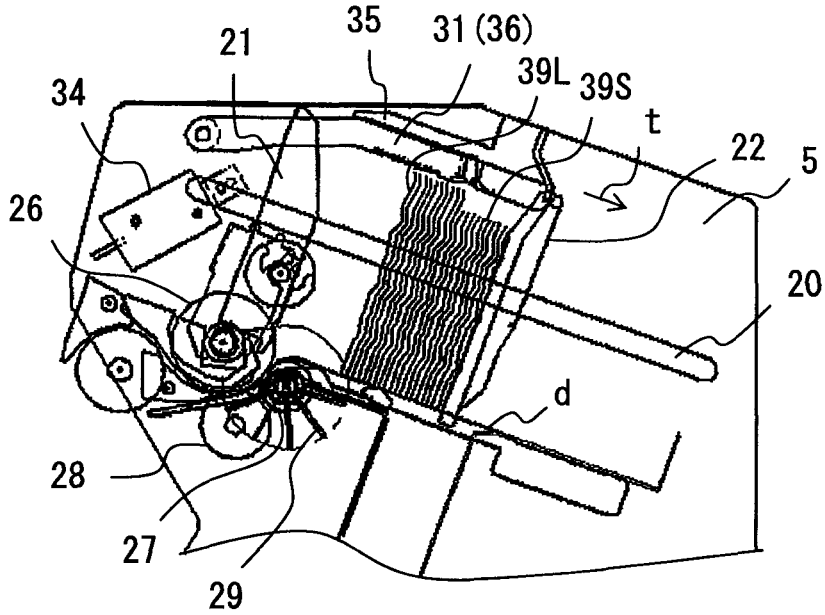

FIGS. 11A and 11B illustrate the turning operations of the alignment lever 31 in the above described process. The process illustrated in FIGS. 10, 11A and 11B is executed in a way such that the controlling unit 40 illustrated in FIG. 5 transmits a command of each task type to the processing unit 42.

The process illustrated in FIG. 10 is started when a dispensing request and a dispensing amount are input by the customer 12 (see FIG. 1) on an operation display screen of the input operation panel unit that is not illustrated and arranged in the vicinity of the outside of the upper surface formed by being slightly tilted in the depositing/dispensing unit 5.

In this dispensing process, bills are accumulated in the temporarily accumulating unit 6 in an increasing order of the width of a bill.

In FIG. 10, the controlling unit 40 starts a sequence of the dispensing process (step S2) upon recognizing that the customer 12 has input the dispensing request via the input operation panel unit (step S1).

In the sequence of the dispensing process, a bill of a certain denomination is initially fed from any of the cassettes A to D to the conveyance path 7*b* according to the amount of money of the dispensing request (step S3).

The fed bill passes through the identifying unit 9 via the conveyance path 7*a*, and the identifying unit 9 identifies whether or not the width of the bill is equal to or smaller than, for example, 71 mm (step S5).

Here, the bill having the width of 71 mm or smaller is a bill of a medium size or a small size stored in the cassettes B to D in the storing unit 4. A bill having a width of 71 mm or larger is a bill of a large size stored in the cassette A.

As described above, in the dispensing process, bills are accumulated in the temporarily accumulating unit 6 in the increasing order of the width of a bill. Therefore, if bills of different sizes are mixedly included in the amount of money of the dispensing request, a bill of a medium size or smaller, namely, a bill having the width of 71 mm or smaller is fed from the storing unit 4 earlier.

Accordingly, the determination in step S5 results in "YES" in this case, and a protrusion process of the bill alignment lever is executed in advance (step S6) before an identified bill is fed to the temporarily accumulating unit 6.

This process is a process for making the holding part lever 36 of the alignment lever 31 descend from the retracted position c where the holding part lever 36 touches the stopper 35 to the descent position c' (see FIG. 3) and for protruding the tips of the comb teeth 37 of the alignment lever 31 into the cutout grooves 38 of the stage plate 22 as illustrated in FIG. 11A so that the front end of the bill is regulated.

As a result of this process, the rear end of the bill 39S of a medium size or a small size accumulated in the temporarily accumulating unit 6 is beaten by the paddles of the partial paddle wheel 29 without floating within the temporarily accumulating unit 6, and the bill 39S is accumulated with the rear end aligned at the bottom position d as described earlier with reference to FIG. 9C.

The controlling unit 40 determines whether or not the bills corresponding to the number of bills of the dispensing request have been fed from the storing unit 4 each time a bill is accumulated (step S7). If the bills have not been fed yet ("NO" in the determination of step S7), the flow goes back to step S2 and the sequence of the dispensing process is repeated.

During the dispensing process, the feed roller 26, the conveyance roller 28 and the separator 27 respectively rotate in the bill carry-in direction as illustrated in FIG. 8B, and the partial paddle wheel 29 rotates to beat the rear end of the carried bill 39S.

Alternatively, if the identifying unit 9 identifies that the width of the bill is larger than 71 mm in step S5 ("NO" in the determination of step S5), the controlling unit 40 then determines whether or not the bill alignment lever protrudes (step S8).

This process is a process for determining whether or not the holding part lever 36 of the alignment lever 31 descends to the descent position c' away from the retracted position c where the holding part lever 36 touches the stopper 35.

If the alignment lever 31 descends to the descent position c', namely, if the tips of the comb teeth 37 protrude into the cutout grooves 38 of the stage plate 22 ("YES" in the determination of step S8), a process for retracting the alignment lever is executed (step S9).

This process is a process for stopping the driving of the solenoid 34, and for turning the alignment lever 31 to the retracted position c where the holding part lever 36 touches the stopper 35. As a result, the tip of a bill of a large size L accumulated in the temporarily accumulating unit 6 moves to a position of being regulated by the alignment lever 31.

Accordingly, the bill of the large size 39L fed into the temporarily accumulating unit 6 is accumulated while its rear end is being beaten by the paddles of the partial paddle wheel 29 and aligned at the bottom position d of the temporarily accumulating unit 6. In this way, the bills 39S and 39L of different sizes are accumulated as a steady bundle.

Also hereafter, in step S7, the controlling unit 40 determines whether or not bills corresponding to the number of bills of the dispensing request have been fed from the storing unit 4. If the bills have not been fed yet, the flow goes back to step S2 and the sequence of the dispensing process is repeated.

In this case, the process for retracting the bill alignment lever has been already executed in the sequence process at a preceding stage. Therefore, the determination of step S8 results in "NO", and the controlling unit 40 immediately transfers to the determination of step S6.

If the bills corresponding to the number of bills within the dispensing request have been fed from the storing unit 4 in the determination of step S7, the dispensing process is terminated (step S10).

Upon termination of the dispensing process, the rotation systems such as the feed roller 26, the conveyance roller 28, the separator 27, the partial paddle wheel 29 and the like stop their rotations.

Hereafter, the roof plate 21 and the stage plate 22 are driven by the driving axis via the long groove hole 20 and move to the depositing/dispensing unit 5 along the bottom position d of the temporarily accumulating unit 6 although this is not particularly illustrated.

As a result, the bills 39S and 39L of different sizes, which are accumulated as the steady bundle in the temporarily accumulating unit 6, move to the depositing/dispensing unit 5 as the steady bundle unchanged, and collectively taken out by the customer 12 as illustrated in FIG. 1.

As described above, with the paper bill depositing/dispensing apparatus 2 according to this embodiment, bills of different sizes can be accumulated as a steady bundle and collectively dispensed at the time of a dispensing process with one simple and compact mechanism that can execute a deposit process and the dispensing process.

Additionally, if the customer 12 accidentally leaves a dispensed bill, the left bill can be also stored in the pool unit 8 or the reject box 13 by applying the operations performed at the time of the deposit process of the same mechanism.

In this way, the present invention is available to a bill deposit/dispensing apparatus that can accumulate bills as a steady bundle and collectively dispense the bills at the time of a dispensing process with one simple and compact mechanism that can execute both a deposit process and the dispensing process.

What is claimed is:

1. A paper bill depositing/dispensing apparatus, comprising:

a depositing/dispensing unit that functions as a paper bill temporarily storing part when a customer inserts a bill in an insertion/withdrawal slot at the time of depositing the bill by the customer and a customer takes a bill out of the insertion/withdrawal slot at the time of dispensing the bill to the customer;

a temporarily accumulating unit for feeding the inserted bill from the depositing/dispensing unit to a conveyance path when the bill is deposited, and for moving a withdrawn bill fed from the conveyance path to the depositing/dispensing unit when the bill is dispensed;

paper bill accumulating means movable along a moving path between the depositing/dispensing unit and the temporarily accumulating unit;

a pick roller provided in the temporarily accumulating unit;

a feed roller, a separator, a conveyance roller and a partial paddle wheel, which are arranged between the temporarily accumulating unit and the conveyance path; and an alignment lever arranged in the temporarily accumulating unit, wherein the paper bill accumulating means forms an inserted bill accepting part or a withdrawn bill dispensing part below the insertion/withdrawal slot when moving to the depositing/dispensing unit, or forms an inserted bill feeding part or a withdrawn bill temporarily accumulating part when moving to the temporarily accumulating unit, when the paper bill accumulating means forms the inserted bill feeding part, the pick roller feeds each topmost bill in a direction of the feed roller by making pressure contact with a bundle of bills stored in the inserted bill feeding part, the feed roller carries the fed bill to the conveyance path along with the conveyance roller, and the partial paddle wheel stops by orientating a round surface, not provided with paddles, toward a path of the carried bill, and when the paper bill accumulating means forms the withdrawn bill temporarily accumulating part, the conveyance roller carries the bill conveyed from the conveyance path to the withdrawn bill temporarily accumulating part along with the feed roller and the separator, the alignment lever regulates a front end of the bill so that a rear end of the bill carried in the withdrawn bill temporarily accumulating part is positioned at a bottom of the withdrawn bill temporarily accumulating part, and the partial paddle wheel prevents a subsequently carried bill from colliding with a foregoing carried bill by rotating to beat the rear end of the bill carried in the withdrawn bill temporarily accumulating part with paddles, further wherein the paper bill accumulating means comprises a roof plate that is erected nearly vertically to the moving path and arranged on a side of the temporarily accumulating unit, and a stage plate that is arranged on a side of the depositing/dispensing unit, and the alignment lever uses, as a retracted position, a position corresponding to a position of a front end of a bill of a maximum size carried in the withdrawn bill temporarily accumulating part, and regulates a front end of a bill of a predetermined size or smaller by descending from the retracted position if the bill carried in the withdrawn bill temporarily accumulating part is the bill of the predetermined size or smaller.

* * * * *